US006397719B1

(12) United States Patent
Vestre

(10) Patent No.: US 6,397,719 B1
(45) Date of Patent: Jun. 4, 2002

(54) METHOD FOR LOADING SLURRY EXPLOSIVES IN BLAST HOLES OR CARTRIDGES

(75) Inventor: Jan Hans Vestre, Reistad (NO)

(73) Assignee: Dyno Nobel ASA, Oslo (NO)

( * ) Notice: Subject to any disclaimer, the term of this patent is extended or adjusted under 35 U.S.C. 154(b) by 0 days.

(21) Appl. No.: 09/508,336

(22) PCT Filed: Sep. 11, 1998

(86) PCT No.: PCT/NO98/00275

§ 371 (c)(1),
(2), (4) Date: Jun. 8, 2000

(87) PCT Pub. No.: WO99/14554

PCT Pub. Date: Mar. 25, 1999

(30) Foreign Application Priority Data

Sep. 12, 1997 (NO) ..... 974226

(51) Int. Cl.[7] ..... F42B 3/00
(52) U.S. Cl. ..... 86/20.15; 102/312; 102/313
(58) Field of Search ..... 86/20.15; 102/312, 102/313

(56) References Cited

U.S. PATENT DOCUMENTS 3,005,373 A * 10/1961 RansoM, Jr. ..... 102/313
3,623,395 A * 11/1971 Paasch et al. ..... 86/20.15
3,769,874 A * 11/1973 Williams et al. ..... 86/20.15
3,770,523 A * 11/1973 Biswas ..... 86/20.15
3,943,820 A 3/1976 Persson ..... 102/312 X
4,699,060 A * 10/1987 Vuillaume et al. ..... 102/313
4,987,818 A * 1/1991 Alford ..... 86/20.15 X
5,007,345 A * 4/1991 O'Garr ..... 102/312 X
5,071,496 A 12/1991 Coursen et al. ..... 102/313 X
5,524,523 A * 6/1996 Lubbe et al. ..... 86/20.15
5,584,222 A 12/1996 Engsbraten et al. .... 102/313 X
5,686,685 A * 11/1997 McDonald et al. ..... 86/20.15
5,712,440 A * 1/1998 Eager et al. ..... 102/313 X
5,798,477 A * 8/1998 Givens et al. ..... 102/313 X
6,125,761 A * 10/2000 Smith, Jr. et al. ..... 102/313
6,165,297 A * 12/2000 Smith et al. ..... 102/313 X
6,210,122 B1 * 4/2001 Brondbo ..... 102/313 X

* cited by examiner

*Primary Examiner*—Peter A. Nelson
(74) *Attorney, Agent, or Firm*—Wenderoth, Lind & Ponack, L.L.P.

(57) ABSTRACT

A method for loading and sensitizing a slurry explosive in a borehole or in a cartridge, where a gassing agent is added as a thin string inside the slurry explosive after the explosive has been pumped into a loading pipe, and wherein the slurry explosive and a gassing agent are mixed at the end of the loading pipe and sensitized in the borehole or the cartridge. Optionally the loading pipe is lubricated with water or a water solution to reduce the pump pressure.

16 Claims, 2 Drawing Sheets

METHOD FOR LOADING SLURRY EXPLOSIVES IN BLAST HOLES OR CARTRIDGES

Figure 1:
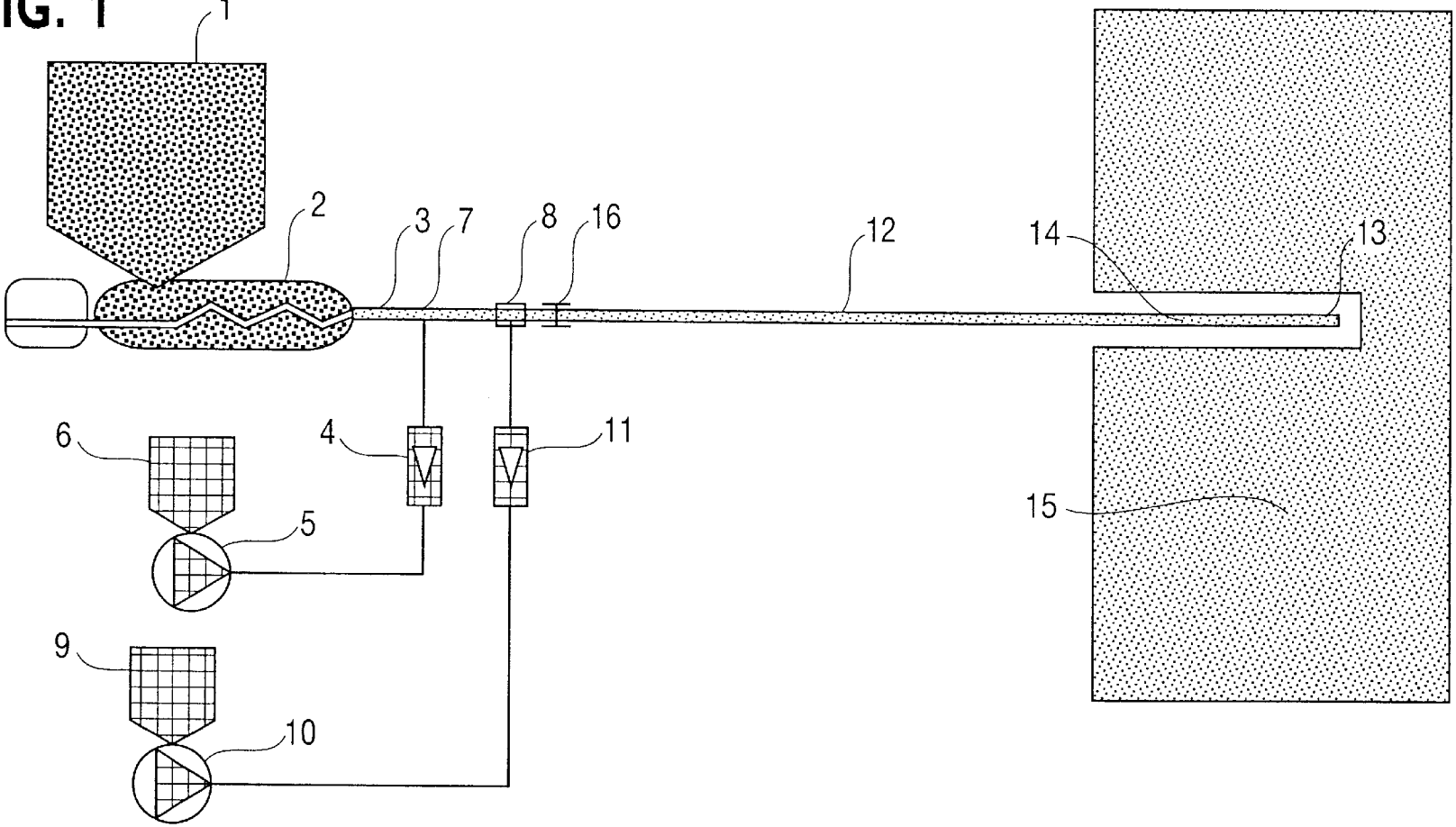

The present invention relates to gassed bulk slurry explosives in general, and gassed bulk explosives of the emulsion slurry type in particular, More specifically the invention relates to a method for loading and sensitising a slurry explosive in a borehole or filling and sensitising a slurry explosive in shells and cartridges Bulk slurry explosives are generally loaded from socalled SMS (Site Mixed Slurry)loading trucks or from a socalled SSE (Site Sensitised Emulsion)-loading truck directly into the customers borehole. In the cartridging of gassed slurry explosives the equipment used is in principle similar to that which is used for SMS loading, with exception that in general water lubrication is not used since this will reduce the quality of the slurry product due to reduction of the energy and detonation properties of the explosive.

The principle for a bulk-SMS-loading truck which supplies a so-called micro balloon sensitised emulsion slurry, has been described in U.S. Pat. No. 5,526,633.

It is usually desirable that slurry explosives have a high viscosity so that the slurry does not flow out in joints and fissures in a rock, during or after loading, or so that the slurry does not flow out of boreholes which are drilled and charged upwards. In order to pump such highly viscous slurry explosives from a loading truck to a borehole it is often necessary to lubricate the loading pipe on the inside with a thin water film which reduces the pump pressure. It is known from U.S. Pat. No. 4,273,147 that by using a water film or water to which ammonium nitrate has been added, which lubricates the loading pipe, it is possible to pump the slurry through long and thin loading pipes without having a dangerously high pumping pressure.

Before U.S. Pat. No. 4,273,147 was generally known, all loading of bulk slurry explosives took place without the use of "lubricating water", but also today such loading may occur when low viscosity slurries are used which are only pumped over relatively short distances, or in the cartridging of slurry explosives.

In U.S. Pat. No. 4,615,752 it shown how one may pump a low viscosity emulsion with water lubrication and then at the end of the pipe thicken (i.e. increase the viscosity of) the emulsion. In order to obtain sufficient lubrication the water film must have a given thickness which is normally attained by adding water in the form of a cylindrical ring in an amount of 2–5% of the total slurry weight. Sometimes water in amounts of above 5% by weight may be necessary.

More and more explosive producers have gradually realised the advantages in using a so called gassed slurry instead of a slurry which has been sensitised with micro balloons or other porous solid additives.

When a slurry is to be gassed chemically, this may either be done by adding the gassing agent to a slurry matrix (i.e. unsensitised slurry explosive) Inside a mixing chamber, usually Immediately before the slurry enters the slurry pump to be pumped down into the borehole or in a cartridge, or the gassing agent may be added to the slurry at the end of the loading pipe immediately before a static mixing means.

The gassing agent may either be transported to the nozzle of the pipe in a separate pipe, or the gassing agent may be added to the lubricating water as described in GB 2 204 343 A.

However, commercially such a pipe end mixing is practised only to a very limited extent due to several practical difficulties connected therewith. Finding suitable equipment which fits into a pipe end and which has a sufficient mixing effect is difficult, but also bringing the gassing agent to the end of the pipe in a reproducable and practical manner represents a problem.

In spite of said difficulties with gassing at the end of a loading pipe it also offers many advantages that a slurry may be gassed at the end of the loading pipe both in a SMS- and a SSE-system, In this manner increased security is attained in view of the fact that all production of the explosive takes place in the borehole or at a safe distance from the production equipment. The loading pipe will only contain small amounts of explosive even if there should be a stop in the loading procedure for unexpected reasons. (Today a SMS loading pipe may contain up to 50 kg of explosive), There is no pumping or, mechanical working of the final explosive. If ignition means should detonate during the introduction of a loading pipe or during the pumping of a slurry, the detonation cannot propagate into the loading pipe back to the loading truck.

As mentioned above, GB 2 204 343 A describes a method in which the gassing agent is conveyed to the end of the pipe by being added to the aqueous lubrication film. However, this involved certain problems.

Firstly, by means of the technique described in GB 2 204 343 A it is not possible to gas emulsions emusified with nitrite as described in Norwegian Patent No. 155 691. Thus, one can not obtain a safe and reproducable gassing if the mixing of gassing agent and emulsion takes place with low intensity, which often occurs with a limited static mixing of gassing agent at the end of the pipe.

Further, it is not possible to add ammonium nitrate (AN) to the lubricating water, as described in U.S. Pat. No. 4,273,147, since AN will react with nitrite, and gassing will then occur during the preparation of the lubricant/gassing agent is mixture.

When a loading pipe is left standing with slurry for a certain period. the water film will gradually be absorbed by the slurry, and in the start-up it may be necessary with a large amount of water film to avoid a loading stop. With the state of art this will result in varying slurry density and an undesired quality of the product.

In order to reduce the density of the slurry to a given level it is necessary to add a certain amount of gassing agent with a given concentration. As mentioned above, the water film will represent 2–5% by weight of the total amount of slurry, and if the water film shall serve as both water film and gassing agent, the concentration of gassing agent must be reduced drastically in comparison with that which is normally used. This means that at the end of the pipe it is necessary to add a larger amount of gassing agent than usual, but also a gassing agent which is highly diluted in comparison with that which is normally used. It has been found to be more difficult as well as less efficient to carry of the mixing with a greater amount of a gassing agent which in addition is diluted.

Further, one looses the possibility of being able to vary the density in one and the same borehole by adding little or much gassing agent, because this will have an effect on the water lubrication, and problems with the water lubrication will result in a clogging of the loading pipe and production stop.

According to the invention there is provided a method of loading and sensitising a slurry explosive in a borehole or filling and sensitising a slurry explosive in shells and cartridges. The method is characterised in that to the unsensitised slurry explosive, after it has been pumped with a slurry pump into a loading pipe, there is added a gassing agent as a thin string centrally in the loading pipe, and unsensitised slurry explosive and the gassing agent are mixed at the nozzle of the loading pipe, so that the unsensitised slurry explosive is not sensitised to the final slurry explosive until it has been loaded into boreholes or filled in shells/cartridges.

In the loading of boreholes lubricating water is suitably injected along the wall of the loading pipe.

Addition of the gassing agent may take place after the slurry pump, but preferably before a possible water lubrication. In principle the gassing agent may be added anywhere in the loading pipe, after the slurry pump, and independently of whether or not "lubricating water" is used.

"The string" of gassing agent follows the slurry flow without being mixed therewith, through the loading pipe, which may be as much as 100 meters long, and will finally, at the end of the loading pipe, become intimately mixed with the slurry so that the slurry develops gas bubbles and thereby gets its density reduced to the desired level.

The slurry remains as a "shell" around the gassing agent, but because the contact surface between the gassing agent and the slurry is so small, these two will not react until they get to the end of the pipe where an intimate mixing of slurry, gassing agent and possible lubricating water takes place.

The gassing agent may for instance be an aqueous nitrite solution, or it may be a nitrite solution emulsified to a water-in-oil-emulsion, see Norwegian Patent No. 155 691. Other gassing agents such as hydrogen peroxide solution may also be used. It is also possible to use other solvents than water in order to dissolve the gassing agent, The lubricating water may be pure water or water to which nitrates, perchlorates and mixtures thereof have been added, so that the total water content in the slurry is not too high when the lubricating water is mixed therewith at the end of the pipe. Thereby the slurry maintains its detonation properties and its strength (energy) even if the lubricating water is mixed wit the slurry at the end of the loading pipe.

The addition of gassing agent by means of said method offers several advantages in comparison with the prior art By using AN in the lubricating water there will be no reduction of the energy and performance of the slurry, in contrast to the situation if water with nitrite is used as lubricating water according to GB 2 204 343 A.

Gassing with nitrite, in particular sodium nitrite, added according to the invention results in a more reliable gassing with negligible variations in slurry density, so that the quality of the final product is better, which consequently means a product with less risk of detonation failure.

The time it takes before the gassing of a slurry has been finished according to the present invention will primarily depend on the temperature and the pH of the slurry matrix. Typical gassing rate will be from 1 to 5 minutes.

Since it according to the present method is possible to use an increased amount of lubricating water to prevent dogging of the pipe and still retain the proper amount of gassing agent, loading stop with slurry in the loading pipe does not create the problems which occur with the technique described in GB 2 204 343 A. The present method may also be used even if "lubricating water" is not used to reduce the pump pressure.

FIG. 1 illustrates an example of how the present invention may be utilised for loading a borehole: Unsensitised slurry explosive (slurry matrix) 1 is pumped with a slurry pump 2 into a slurry loading pipe 3, 12 which may comprise a rigid part 3 and a more flexible part (hose) 12, where gassing agent 6 is added by means of a pump 5 through a flow meter 4 to a point of addition 7 which is in the centre of the slurry loading pipe 3, 12. The slurry explosive 1 flows then to a water lubrication unit 8 in which lubricating water 9 is pumped with a pump 10 through a flow meter 11 to the water lubrication unit 8 in which the lubricating water 9 forms a thin cylindrical shell between the wall of the slurry loading pipe 3, and around the flow of slurry explosive 1. Accordingly, the slurry explosive 1 with a core of gassing agent 6 and a film of lubricating water 9 on the outside flows through the rigid part of the slurry loading pipe 3 and through the more flexible part 12 through a fitting 16 to the end of the flexible part of the loading pipe 12 where all the three components are mixed in a static mixing unit 13. In this manner the slurry explosive 1 is sensitised while it is loaded into a borehole 14 which has been drilled in a rock 15 which is to be blown up.

In the same manner it is possible to load cartridges, wherein the loading does not take place in a borehole but in a cartridge or a shell, in particular plastic cartridges or in paper or cardboard shells. The cartridge or the shell loaded with explosive may then be inserted in a borehole. This may for Instance be desirable when the conditions make it difficult to get close with a loading truck, The advantage in using the present invention for cartridging of slurry explosives in shells and cartridges is also that with this technique the final sensitised explosive does not exist until a few minutes after the slurry has been filled into the cartridges or shells. Thereby the explosive itself has been removed from the production unit, and the explosive is only present in cooling units or in final boxes where the mechanical strain is negligible. This reduces the risk of undesired detonation during the production.

Figure 2:
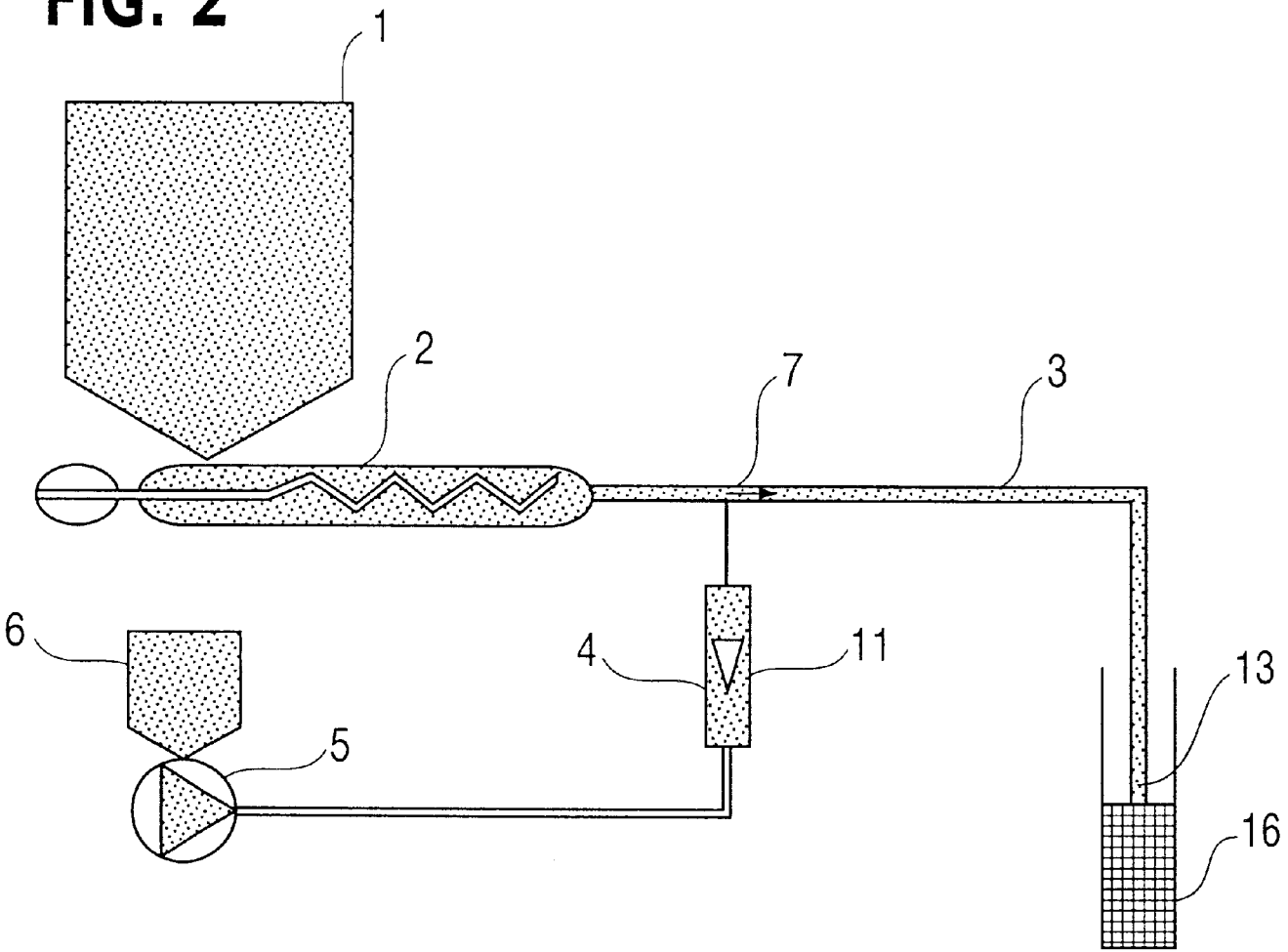

FIG. 2 illustrates an example of how the present invention may be used for cartridging slurry explosives: The slurry matrix 1 (which is an unsensitised slurry explosive) which is suitably of the emulsion type, Is pumped with a slurry pump 2 into a loading pipe 3 in which the gassing agent 6 is added by means of a pump 5 through a flow meter 4 to an addition point 7 which is centrally located in the loading pipe, The slurry matrix 1 (which has not yet been sensitised) flows through the loading pipe 3 to the end, where the slurry matrix 1 and the gassing agent 6 are mixed in a static mixing unit 13. The slurry matrix 1 mixed with gassing agent 6 is then filled into shells or cartridges 16, which are transported away from the production unit for cooling and packing, where the gassing agent 6 added has the effect that the slurry matrix 1 is "gassed" to a final slurry explosive.

What is claimed is:

1. A method of loading and sensitizing a slurry explosive in a borehole, comprising the steps of:

pumping an unsensitized slurry explosive into a loading pipe to form a stream of unsensitized slurry explosive, adding a gassing agent in the form of a thin stream into the center of the stream of unsensitized slurry explosive, and mixing the unsensitized slurry explosive and the gassing agent at the end of the loading pipe disposed within the borehole, wherein the unsensitized slurry explosive is sensitized into a final slurry explosive as it enters the borehole.

2. The method according to claim 1, wherein a lubricating water is injected along the inner wall of the loading pipe during the pumping of the unsensitized slurry explosive.

3. The method according to claim 1, wherein the unsensitized slurry explosive is an emulsion.

4. The method according to claim 1, wherein the gassing agent is dissolved in water or another solvent.

5. The method according to claim 1, wherein the gassing agent is an aqueous gassing agent which has been emulsified into a water-in-oil emulsion.

6. The method according to claim 1, wherein the gassing agent is sodium nitrite.

7. The method according to claim 1, wherein the lubricating water is pure water which reduces a pump pressure.

8. The method according to claim 2, wherein the lubricating water is water containing at least one of ammonium nitrate or other nitrates, perchlorates and mixtures thereof.

9. A method of filling and sensitizing a slurry explosive in a shell or cartridge, comprising the steps of:

pumping an unsensitized slurry explosive into a loading pipe to form a stream of unsensitized slurry explosive, adding a gassing agent in the form of a thin stream into the center of the stream of unsensitized slurry explosive, and mixing the unsensitized slurry explosive and the gassing agent at the end of the loading pipe disposed within the shell or cartridge, wherein the unsensitized slurry explosive is sensitized into a final slurry explosive as it enters the shell or cartridge.

10. The method according to claim 9, wherein a lubricating water is injected along the inner wall of the loading pipe during the pumping of the unsensitized slurry explosive.

11. The method according to claim 9, wherein the unsensitized slurry explosive is an emulsion.

12. The method according to claim 9, wherein the gassing agent is dissolved in water or another solvent.

13. The method according to claim 9, wherein the gassing agent is an aqueous gassing agent which has been emulsified into a water-in-oil emulsion.

14. The method according to claim 9, wherein the gassing agent is sodium nitrite.

15. The method according to claim 9, wherein the lubricating water is pure water which reduces a pump pressure.

16. The method according to claim 10, wherein the lubricating water is water containing at least one of ammonium nitrate or other nitrates, perchlorates and mixtures thereof.

* * * * *